US005698509A

United States Patent [19]

Nedonchelle

[11] Patent Number: 5,698,509

[45] Date of Patent: Dec. 16, 1997

[54] POURABLE ABRASIVE AQUEOUS DETERGENT COMPOSITION FOR CLEANING HARD SURFACES

[75] Inventor: Yvon Jacques Nedonchelle, Lille, France

[73] Assignee: Lever Brothers Company, Division of Conopco, Inc., New York, N.Y.

[21] Appl. No.: 803,765

[22] Filed: Dec. 5, 1991

Related U.S. Application Data

[63] Continuation of Ser. No. 523,307, May 10, 1990, abandoned, which is a continuation of Ser. No. 252,005, Sep. 28, 1988, abandoned, which is a continuation of Ser. No. 828,793, Feb. 12, 1986, abandoned.

[30] Foreign Application Priority Data

Feb. 26, 1985 [GB] United Kingdom ..... 8504862

[51] Int. Cl.[6] ..... C11D 1/12; C11D 1/66; C11D 3/10

[52] U.S. Cl. ..... 510/424; 510/214; 510/256; 510/422; 510/425; 510/509

[58] Field of Search ..... 252/174.14, 173, 252/550, 551, 554, 555, 558, 559, DIG. 2, DIG. 14; 510/214, 256, 422, 424, 425, 509

[56] References Cited

U.S. PATENT DOCUMENTS

| | | | |
|---|---|---|---|
| 2,864,770 | 12/1958 | McCune et al. | 252/539 |
| 3,232,878 | 2/1966 | Jones et al. | 510/418 |
| 3,672,993 | 6/1972 | Mitchell et al. | 134/3 |
| 3,827,983 | 8/1974 | Mitchell et al. | 510/198 |
| 3,981,826 | 9/1976 | Munro | 252/526 |
| 4,051,055 | 9/1977 | Trinh | 252/95 |
| 4,057,506 | 11/1977 | Sung | 252/135 |
| 4,107,067 | 8/1978 | Murphy et al. | 252/135 |
| 4,179,414 | 12/1979 | Clayton | 510/404 |
| 4,244,840 | 1/1981 | Straw | 252/540 |
| 4,264,466 | 4/1981 | Carleton et al. | 252/99 |
| 4,302,347 | 11/1981 | Straw et al. | 252/116 |
| 4,530,775 | 7/1985 | Brierley et al. | 252/128 |
| 4,530,780 | 7/1985 | van de Pas et al. | 252/528 |
| 4,537,708 | 8/1985 | Downey et al. | 252/554 |
| 4,544,494 | 10/1985 | Downey et al. | 252/135 |
| 4,597,889 | 7/1986 | Jones et al. | 252/135 |
| 4,615,819 | 10/1986 | Leng et al. | 252/110 |
| 4,618,446 | 10/1986 | Haslop et al. | 252/135 |
| 4,659,497 | 4/1987 | Akred et al. | 252/135 |
| 4,842,767 | 6/1989 | Warschewski et al. | 252/525 |
| 4,869,842 | 9/1989 | Denis et al. | 252/121 |

FOREIGN PATENT DOCUMENTS

| | | |
|---|---|---|
| 1250949 | 9/1967 | Germany . |
| 7011677 | 2/1971 | Netherlands . |
| 882569 | 8/1959 | United Kingdom . |
| 2060677 | 6/1983 | United Kingdom . |

*Primary Examiner*—Ponnathapura Achutamurthy
*Attorney, Agent, or Firm*—Ronald A. Koatz

[57] ABSTRACT

A pourable, homogenous, abrasive aqueous detergent composition, suitable for cleaning hard surfaces contains detergent active compound which is preferably a mixture of anionic and nonionic detergent active compounds, and a water-soluble salt in an amount sufficient to provide undissolved particles which act as an abrasive. The composition has an apparent viscosity which is sufficient to maintain the particles of salt in suspension during storage while ensuring that the composition remains pourable.

10 Claims, No Drawings

POURABLE ABRASIVE AQUEOUS DETERGENT COMPOSITION FOR CLEANING HARD SURFACES

This is a continuation application of Ser. No. 07/523,307, filed May 10, 1990, abandoned, which is a continuation of U.S. Ser. No. 252,005, filed Sep. 28, 1988, abandoned, which is a continuation of U.S. Ser. No. 828,793, filed Feb. 12, 1986, abandoned.

TECHNICAL FIELD

The invention relates to pourable, homogenous, aqueous liquid detergent compositions, especially compositions containing a particulate abrasive which are suited to the cleaning of hard surfaces.

BACKGROUND

Liquid detergent compositions for cleaning hard surfaces are generally classified into two types. The first are aqueous suspensions containing water-insoluble palpable abrasive particles; such compositions can suffer from a stability problem and tend to be gritty in use, such that the hard surface being cleaned can become scratched. Also, difficulty can be experienced when rinsing with water a hard surface that has been cleaned with such a composition, as insoluble particles of the abrasive can be difficult to remove completely from the surface. The second are liquid detergent compositions, usually containing soap, nonionics and alkyl benzene sulphonate, but with no palpable abrasive particles.

Liquid detergent compositions of the latter type, although free from the possible problem of scratching in use, nevertheless suffer from a number of drawbacks which can limit their consumer acceptability. They can, for example, have poor cleaning performance on stubborn soil, especially in areas where the water is hard, due to the absence of an abrasive constituent. Also, they can suffer from poor homogeneity and can possess viscosity characteristics which are not ideal for use by the consumer. Moreover, the higher surfactant concentration necessary for in-use removal of grease and fatty soils can lead to excessive suds formation, which requires rinsing and wiping by the user. Although excessive suds production can be controlled to some extent by incorporation of a suds-regulating material such as solvents, hydrophobic silica and/or silicone or soap, this in itself can raise problems of poor product stability and homogeneity, and problems associated with deposition of insoluble residues on the items or surfaces being cleaned, leading to residual streaks and spots when dried.

It has been proposed in U.S. Pat. No. 4,057,506 (Colgate Palmolive Company) to employ in a heavy-duty liquid detergent composition a builder salt such as a water-soluble phosphate, silicate, borate, carbonate, bicarbonate or citrate in a manner such that the composition is substantially devoid of any builder salt in the form of solid particles, the composition being otherwise smooth and creamy. It is however an essential feature of the Colgate Palmolive's composition that any of the builder salt that is present in solid form is of colloidal-size particles having a particle size of <1μ, usually <0.1μ.

It would appear that builder salt particles of this dimension, while possibly functioning as a builder, are too small to function as an abrasive. Such compositions are accordingly ineffective in cleaning heavily soiled hard surfaces as they lack scouring ability.

It has also been proposed in U.S. Pat. No. 4,051,055 (Procter & Gamble) to employ up to 50% by weight of sodium bicarbonate as a buffering agent or detergency builder in a cleansing composition for use on porcelain enamel surfaces, this composition also containing an hypochlorite, a fluoride salt and a clay with cation exchange capacity.

It has also been proposed in U.S. Pat. No. 4,179,414 (Mobil Oil) to employ from 50 to 65% by weight of sodium bicarbonate in a paste that is suitable for cleaning hard surfaces.

It would appear that neither the Procter & Gamble nor the Mobil reference suggests a pourable liquid hard surface cleaner having a consistency which prevents sedimentation on standing of solid particulate matter while the product remains pourable.

It has now been discovered that a pourable aqueous liquid hard surface abrasive cleaner having superior suspending properties and excellent cleaning ability, properties with low soil redeposition and little or no propensity to causing streaking or spotting on surfaces washed therewith due to residual abrasive particles can be prepared using a special water-soluble salt having a specified particle size, together with an agent for critical adjustment of viscosity.

SUMMARY OF THE INVENTION

Accordingly, the invention provides a pourable, homogenous, abrasive, aqueous detergent composition suitable for cleaning hard surfaces comprising, in addition to water:

i) 1.5 to 30% by weight of detergent active compound; and ii) a water-soluble salt at least 5% by weight of the composition of which at 20° C. is in the form of undissolved particles having a mean particle diameter of from 10 to 500 μm, the salt having:

(a) not more than a single hydrated species when present as a crystalline solid in water at a temperature of from 10° to 40° C. in an amount above that required to form a saturated solution, and (b) a saturation solubility in water at 40° C. which is less than ten times that at 10° C., the total amount of said salt forming from 6 to 45% by weight of the composition;

iii) the balance of the composition comprising water and other detergent adjuncts, the composition having an apparent viscosity at 20° C. of at least 6500 Pas at a shear rate of $3\times10^{-5}$ $sec^{-1}$ and not more than 10 Pas at a shear rate of 21 $sec^{-1}$.

DISCLOSURE OF THE INVENTION

Detergent Active Compound

The composition according to the invention will comprise detergent actives chosen from both synthetic anionic and nonionic detergent actives.

Suitable synthetic anionic detergent active compounds are water-soluble salts of organic sulphuric reaction products having in the molecular structure an alkyl radical containing from 8 to 22 carbon atoms, and a radical chosen from sulphonic acid or sulphur acid ester radicals and mixtures thereof. Examples of synthetic anionic detergents are sodium and potassium alkyl sulphates, especially those obtained by sulphating the higher alcohols produced by reducing the glycerides of tallow or coconut oil; sodium and potassium alkyl benzene sulphates such as those in which the alkyl group contains from 9 to 15 carbon atoms; sodium alkyl glyceryl ether sulphates, especially those ethers of the higher alcohols derived from tallow and coconut oil; sodium coconut oil fatty acid monoglyceride sulphates; sodium and potassium salts of sulphuric acid esters of the reaction product of one mole of a higher fatty alcohol and from 1 to 6 moles of ethylene oxide; sodium and potassium salts of alkyl phenol ethylene oxide ether sulphate with from 1 to 8 units of ethylene oxide molecule and in which the alkyl radicals contain from 4 to 14 carbon atoms; the reaction product of fatty acids esterified with isethionic acid and neutralised with sodium hydroxide where, for example, the fatty acids are derived from coconut oil and mixtures thereof.

The preferred water-soluble synthetic anionic detergent active compounds are the ammonium and substituted ammonium (such as mono, di and triethanolamine), alkaline metal (such as sodium and potassium) and alkaline earth metal (such as calcium and magnesium) salts of higher alkyl benzene sulphates and mixtures with olefinsulphonates and higher alkyl sulphates, and the higher fatty acid monoglyceride sulphates. The most preferred anionic detergent active compounds are higher alkyl aromatic sulphonates such as higher alkyl benzene sulphonates containing from 6 to 20 carbon atoms in the alkyl group in a straight or branched chain, particular examples of which are sodium salts of higher alkyl benzene sulphonates or of higher-alkyl toluene, xylene or phenol sulphonates, alkyl naphthalene sulphonates, ammonium diamyl naphthalene sulphonate, and sodium dinonyl naphthalene sulphonate.

The amount of synthetic anionic detergent active to be employed in the detergent composition of this invention will generally be from 1 to 25%, preferably from 2 to 20%, and most preferably from 2 to 15% by weight.

Suitable nonionic detergent active compounds can be broadly described as compounds produced by the condensation of alkylene oxide groups, which are hydrophilic in nature, with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Particular examples include the condensation product of aliphatic alcohols having from 8 to 22 carbon atoms in either straight or branched chain configuration with ethylene oxide, such as a coconut oil ethylene oxide condensate having from 2 to 15 moles of ethylene oxide per mole of coconut alcohol; condensates of alkylphenols whose alkyl group contains from 6 to 12 carbon atoms with 5 to 25 moles of ethylene oxide per mole of alkylphenol; condensates of the reaction product of ethylenediamine and propylene oxide with ethylene oxide, the condensates containing from 40 to 80% of polyoxyethylene radicals by weight and having a molecular weight of from 5,000 to 11,000; tertiary amine oxides of structure $R_3NO$, where one group R is an alkyl group of 8 to 18 carbon atoms and the others are each methyl, ethyl or hydroxyethyl groups, for instance dimethyldodecylamine oxide; tertiary phosphine oxides of structure $R_3PO$, where one group R is an alkyl group of from 10 to 18 carbon atoms, and the others are each alkyl or hydroxyalkyl groups of 1 to 3 carbon atoms, for instance dimethyldodecylphosphine oxide; and dialkyl sulphoxides of structure $R_2SO$ where the group R is an alkyl group of from 10 to 18 carbon atoms and the other is methyl or ethyl, for instance methyltetradecyl sulphoxide; fatty acid alkylolamides; alkylene oxide condensates of fatty acid alkylolamides and alkyl mercaptans.

The amount of nonionic detergent active to be employed in the detergent composition of the invention will generally be from 0.5 to 15%, preferably from 1 to 10%, and most preferably from 1 to 8% by weight.

The weight ratio of anionic detergent to nonionic detergent active may vary but is preferably in the range of from 1:1 to 9:1, ideally from 2:1 to 4:1.

Preferably, the compositions contain an amount of both the anionic and the nonionic detergent active which is chosen so as to provide a structured liquid detergent composition, i.e. one which is 'self' thickened without necessarily employing any thickening agent per se.

According to a preferred embodiment illustrating this aspect of the invention, the detergent compositions will comprise from 2 to 8% by weight of a water-soluble, synthetic anionic sulphated or sulphonated detergent salt containing an alkyl radical having from 8 to 22 carbon atoms in the molecule, and from 0.5 to 4% by weight of an alkyleneoxylated nonionic detergent derived from the condensation of an aliphatic alcohol having from 8 to 22 carbon atoms in the molecule with ethylene oxide, such that the condensate has from 2 to 15 moles of ethylene oxide per mole of aliphatic alcohol.

It is also possible optionally to include amphoteric, cationic or zwitterionic detergent actives in the compositions according to the invention.

Suitable amphoteric detergent-active compounds that optionally can be employed are derivatives of aliphatic secondary and tertiary amines containing an alkyl group of 8 to 18 carbon atoms and an aliphatic radical substituted by an anionic water-solubilising group, for instance sodium 3-dodecylamino-propionate, sodium 3-dodecylaminopropane sulphonate and sodium N-2-hydroxydodecyl-N-methyltaurate.

Suitable cationic detergent-active compounds are quaternary ammonium salts having an aliphatic radical of from 8 to 18 carbon atoms, for instance cetyltrimethyl ammonium bromide.

Suitable zwitterionic detergent-active compounds that optionally can be employed are derivatives of aliphatic quaternary ammonium, sulphonium and phosphonium compounds having an aliphatic radical of from 8 to 18 carbon atoms and an aliphatic radical substituted by an anionic water-solubilising group, for instance 3-(N,N-dimethyl-N-hexadecylammonium)propane-1-sulphonate betaine, 3-(dodecylmethyl sulphonium) propane-1-sulphonate betaine and 3-(cetylmethylphosphonium) ethane sulphonate betaine.

Further examples of suitable detergent-active compounds are compounds commonly used as surface-active agents given in the well-known textbooks "Surface Active Agents", Volume I by Schwartz and Perry and "Surface Active Agents and Detergents", Volume II by Schwartz, Perry and Berch.

The total amount of detergent active compound to be employed in the detergent composition of the invention will generally be from 1.5 to 30%, preferably from 2 to 10% by weight.

The Water-soluble Salt

The composition according to the invention will also comprise at least one water-soluble salt which can function both as an abrasive and as a detergency builder. This salt will be present in the composition in an amount in excess of its saturation solubility, and will accordingly be present in both a dissolved and an undissolved state. The composition will therefore comprise a saturated aqueous solution of the salt, together with at least 5% by weight of the composition at 20° C. in the form of a solid phase comprising particles of the salt having a mean particle diameter of from 10 to 500 μm, preferably from 20 μm to 300 μm, to provide the necessary abrasive properties.

The water-soluble salt is preferably an inorganic salt, normally possessing not more than a single hydrated species when present as a crystalline solid in water at a temperature of from 10° to 40° C. in an amount in excess of that required to form a saturated solution. The saturation solubility of the salt in water at 40° C. will be less than ten times, preferably less than eight times, and most preferably less than twice that at 10° C. This is to ensure that the characteristics of the product, in particular the size, shape and amount of crystalline abrasive particles, do not change significantly over the normal temperature range of use. Uniformity of performance is accordingly ensured. It is also apparent that the choice of a salt having the properties as defined herein will ensure that when the compositions is self structured, that is the structure which provides the desired viscosity characteristics is derived from an appropriate choice of anionic and nonionic detergent actives, it will remain stable without substantial change in viscosity.

Preferably, the water-soluble salt will have a Mohs hardness of at least 2 and less than 3, and a saturation solubility in water which at 10° C. does not exceed 15% by weight.

The salt will also have a solubility in water of at least 5 g/l at 10° C., to ensure that any surplus salt can readily be rinsed from a hard surface after cleaning with the composition. In this way, the surface can be free from residual spots or streaks.

The preferred salts chosen for this dual role of both builder and abrasive are given below together with data relevant to their saturation solubility in water and their hydrated species.

| Salt | Solubility (% w/v) at 10° C. | Solubility (% w/v) at 40° C. | Hydrated species (10° C.–40° C.) |
|---|---|---|---|
| sodium bicarbonate ($NaHCO_3$) | 8 | 13 | None |
| sodium tripolyphosphate pentahydrate ($Na_5P_3O_{10}.5H_2O$) | 14 | 14 | $5H_2O$ |
| sodium tetraborate decahydrate ($Na_2B_4O_7.10H_2O$) | 1.2 | 9.5 | $10H_2O$ |

The ideal salt is sodium bicarbonate.

Mixtures of these salts can be employed.

The advantages of employing sodium bicarbonate are that:

(i) it is cheap and readily available;

(ii) it is non-toxic and does not harm the skin;

(iii) its solubility in water does not vary much over the normal product storage temperature range of from 0° to 40° C., its solubility in g per 100 ml at 10° C. being 8 and at 40° C. being 13;

(iv) its saturation solubility in water at 10° C. being about 8% by weight ensures that an excess of it will remain undissolved in the detergent composition to provide abrasive properties, whereas it is sufficiently soluble in water to dissolve when finally rinsing with water a hard surface that has been cleaned with the detergent composition;

(v) it exists only in one crystalline form between 10° and 40° C. and does not exist as an hydrated form (i.e. it does not contain water of crystallisation); its crystalline structure will therefore remain unchanged in the detergent composition during storage at normal temperatures;

(vi) the crystalline form is sufficiently hard to exhibit good cleaning qualities, but since its hardness is a little less than that of calcite (ie it has a hardness of less than 3 on the Moh scale), it is less likely to scratch a hard surface to the degree that can occur when using similar products containing a water-insoluble abrasive such as calcite, which has a Mohs hardness of 3.

No other abrasive material exhibits all these qualities.

The total amount of the water-soluble salt present in the detergent composition, both in dissolved and undissolved form, should be from 6 to 45%, preferably from 10 to 40%, and ideally 15 to 40% by weight. At least 5% by weight of the water-soluble salt should be present in the composition, at normal storage or use temperatures of from 10° to 40° C., in a solid, particulate form, having an average particulate size, and other characteristics, as herein defined.

In addition to sodium bicarbonate, sodium tripolyphosphate pentahydrate and sodium tetraborate decahydrate, the composition according to the invention can also optionally comprise other water-soluble inorganic salts or organic salts of lithium, magnesium, sodium, potassium and calcium, which salts can also function as builders and abrasives. Specific examples are sodium oxalate, sodium succinate, sodium adipate and sodium glutarate. Each of these optional salts can be present in the composition in an amount below or above its relevant saturation solubility. Mixtures of such salts can be employed.

Water

The composition according to the invention will also comprise water which will generally form from 30 to 92.5%, preferably from 40 to 80%, and ideally 50 to 70% by weight of the composition.

Optional Ingredients

The composition according to the invention can contain other ingredients which aid in their cleaning performance. For example, the composition can contain detergent builders other than the special water-soluble salts, as defined herein, such as nitrilotriacetates, polycarboxylates, citrates, dicarboxylic acids, water-soluble phosphates especially polyphosphates, mixtures of ortho- and pyrophosphate, zeolites and mixtures thereof. Such builders can additionally function as abrasives if present in an amount in excess of their solubility in water as explained herein. In general, the builder, other than the special water-soluble salts when employed, preferably will form from 0.1 to 25% by weight of the composition.

Metal ion sequestrants such as ethylenediaminetetraacetates, amino-polyphosphonates (DEQUEST) and phosphates and a wide variety of other poly-functional organic acids and salts, can also optionally be employed.

A further optional ingredient for compositions according to the invention is a suds regulating material, which can be employed in compositions according to the invention which have a tendency to produce excessive suds in use. One example of a suds regulating material is soap. Soaps are salts of fatty acids and include alkali metal soaps such as the sodium, potassium, ammonium and alkanol ammonium salts of higher fatty acids containing from about 8 to about 24 carbon atoms, and preferably from about 10 to about 20 carbon atoms. Particularly useful are the sodium and potassium and mono-, di- and triethanolamine salts of the mixtures of fatty acids derived from coconut oil and ground nut oil. When employed, the amount of soap can form at least 0.005%, preferably 0.5% to 2% by weight of the composition. A further example of a suds regulating material is an organic solvent, hydrophobic silica and a silicone oil or hydrocarbons.

The compositions according to the invention may optionally contain structuring agents to aid in providing appropriate rheological properties to maintain the undissolved salt or salts uniformly distributed in the composition and in enhancing their distribution and adherence of the composition to the hard surface to be cleaned. Preferred structuring agents include polysaccharides, such as sodium carboxymethyl cellulose and other chemically modified cellulose materials, xanthan gum and other non-flocculating structuring agents such as Biopolymer PS87 referred to in U.S. Pat. No. 4,329,448. Certain polymers such as a polymer of acrylic acid cross-linked with a poly functional agent, for example CARBOPOL, can also be used as structuring agents. The amount of such structuring agents, when employed, to be used in compositions according to the invention can be as little as 0.001%, preferably at least 0.01% by weight of the composition.

The compositions according to the invention can also comprise at least partially esterified resin such as an at least partially esterified adduct of rosin and an unsaturated dicarboxylic acid or anhydride, or an at least partially esterified derivatives of co-polymerisation products of mono-unsaturated aliphatic, cycloaliphatic or aromatic monomers having no carboxy groups and unsaturated dicarboxylic acids or anhydrides thereof.

Typical examples of suitable copolymers of the latter type are copolymers of ethylene, styrene, and vinylmethylether with maleic acid, fumaric acid, itaconic acid, citraconic acid and the like and the anhydrides thereof. Preferred are the styrene/maleic anhydride copolymers.

In general, the compositions of the invention can optionally comprise from 0.005 to 20%, usually from 0.1 to 15% and preferably from 0.5 to 10% by weight of the at least partially esterified resin.

Compositions according to the invention can also contain, in addition to the ingredients already mentioned, various other optional ingredients such as pH regulants, perfumes, colourants, optical brighteners, soil suspending agents, detersive enzymes, compatible bleaching agents, gel-control agents, freeze-thaw stabilisers, bactericides, preservatives, detergent hydrotropes, opacifiers and solvents.

The compositions according to the invention will not contain more than 10%, preferably not more than 5% by weight of a water-insoluble abrasive, such as calcite, in view of the tendency of such abrasives to leave a deposit on hard surfaces after cleaning, even when rinsed with water.

Ideally, compositions according to the invention are substantially free from water-insoluble abrasives.

Generally, the water and optional ingredients comprising other detergent adjuncts will form the balance of the composition, after accounting for the detergent active compound and the water soluble salt ingredients. Accordingly, the water and optional ingredients can form from 92.5 to 25% by weight of the composition.

pH

Compositions according to the invention are usually formulated in the alkaline pH range, and will generally have a pH of from 7 to 13, preferably about 7 to 11. Alkalising agents such as sodium hydroxide and sodium carbonate can be used to adjust and buffer the pH as desired.

Suspending Properties

It is an important feature of the invention that the composition will be capable of suspending the undissolved particles of salt abrasive, so that the consumer does not need to agitate the composition, for example by shaking it, in order to re-suspend and re-distribute sedimented particles prior to use. For this purpose, the composition should preferably have an apparent viscosity at 20° C. of at least 6500 Pas at a shear rate of $3\times10^{-5}$ sec.$^{-1}$ to ensure that the particles of salt abrasive do not sediment on standing at 20° C. by more than 1 cm in one month. Ideally, the apparent viscosity at 20° C. is at least 25,000 Pas at a shear rate of $3\times10^{-5}$ sec.$^{-1}$.

This viscosity value can be determined by application of Stokes Law, with the assumption that the particles of salt abrasive are spherical, and that the above sedimentation rate applies.

While it is necessary to ensure that the composition according to the invention has an apparent viscosity which is high enough to prevent any substantial settlement of the undissolved particles of salt abrasive during storage, it should remain fluid, so that it can readily be poured from a bottle or other container when required for use. For this purpose, the composition should have an apparent viscosity at 20° C., measured using a rotational viscometer which does not exceed 10 Pas at a shear rate of 21 sec.$^{-1}$. Preferably, the apparent viscosity at 20° C. is no greater than 5 Pas at a shear rate of 21 sec$^{-1}$.

Suitable rheological conditions to suit these critera can be provided by judicial choice of anionic and nonionic detergent to provide a structured liquid having the requisite suspending properties, and/or by use of an appropriate amount of an alternative structuring agent such as is described herein.

Process for Preparation of Compositions

Since the compositions according to the invention are in liquid form, they can be prepared simply by blending the essential and optional ingredients in water.

Packaging and Use of the Compositions

The compositions according to the invention are pourable liquids that are preferably contained in a closable container for convenience of storage, transport and sale, without spillage.

The compositions are particularly suited to the cleaning of soiled hard surfaces, such as those to be found in the domestic kitchen and bathroom. The compositions can be used neat, that is without dilution, or they can first be diluted as required with water before application to a soiled surface using, for example, a cloth, brush or sponge for ease of application. Following use, any surplus undissolved water-soluble salt abrasive remaining on the surface can readily be removed by rinsing with clean water in which it dissolves.

Surfaces cleaned in this way with compositions of the invention show less of a tendency to residual streaking or spotting than surface cleaned with corresponding products containing water-insoluble abrasives such as calcite.

EXAMPLES

The invention is illustrated by the following Examples.

Example 1

This example illustrates the formulation of a concentrated detergent composition according to the invention containing sodium bicarbonate as the water-soluble abrasive salt, which is suitable for cleaning hard surfaces such as sinks, worktops, baths and floors.

The formulation of this detergent concentrate was as follows:

| | % w/w |
|---|---|
| Sodium alkylbenzene sulphonate | 4.875 |
| Ethoxylate fatty alcohol $C_{9-11}$.8EO | 1.625 |
| Sodium bicarbonate | 29.3 |
| Water | to 100 |
| weight ratio of anionic detergent to nonionic detergent = 3:1 | |
| viscosity at 20° C. = 0.15 Pas at a shear rate of 21 sec.$^{-1}$, and >6500 Pas at a shear rate of 3 × $10^{-5}$sec.$^{-1}$ | |

This liquid detergent concentrate can be used undiluted as a liquid scourer or diluted with about 100 times its volume of water and applied to floors or other hard surfaces in order to remove fat, oil and others soils, using a suitable applicator. Rinsing the surface afterwards with water will readily remove any residual sodium bicarbonate.

Example 2

This example illustrates the formulation of a concentrated detergent composition according to the invention containing a mixture of sodium bicarbonate and sodium tripolyphosphate pentahydrate as the water-soluble abrasive salts, which is suitable for cleaning hard surfaces such as sinks, worktops, baths and floors.

The formulation of this detergent concentrate was as follows:

| | % w/w |
|---|---|
| Sodium alkylbenzene sulphonate | 7.2 |
| Ethoxylate fatty alcohol $C_{13-15}$.7EO (SYNPERONIC A7) | 0.8 |
| Sodium bicarbonate | 7.68 |
| Sodium tripolyphosphate pentahydrate | 20 |
| Water | 64.2 |
| weight ratio of anionic detergent to nonionic detergent = 9:1 | |
| viscosity at 20° C. = 0.21 Pas at a shear rate of 21 sec.$^{-1}$, and >6500 Pas at a shear rate of 3 × $10^{-5}$ sec.$^{-1}$. | |

This liquid detergent concentrate can be used undiluted as a liquid scourer or diluted with about 100 times its volume of water and applied to floors or other hard surfaces in order to remove fat, oil and others soils, using a suitable applicator. Rinsing the surface afterwards with water will readily remove any residual salts.

Example 3

This example illustrates the formulation of a concentrated detergent composition according to the invention containing a mixture of sodium bicarbonate and sodium tetraborate decahydrate as the water-soluble abrasive salts, which is suitable for cleaning hard surfaces such as sinks, worktops, baths and floors.

The formulation of this detergent concentrate was as follows:

| | % w/w |
|---|---|
| Sodium alkylbenzene sulphonate | 6 |
| Ethoxylate fatty alcohol $C_{9-11}$.8EO (DOBANOL 91-8) | 2 |
| Sodium bicarbonate | 7.68 |
| Sodium tetraborate decahydrate | 20 |
| Water | 64.32 |
| weight ratio of anionic detergent to nonionic detergent = 3:1 | |
| viscosity at 20° C. = 0.28 Pas at a shear rate of 21 sec$^{-1}$, and >6500 Pas at a shear rate of 3 × $10^{-5}$ sec$^{-1}$. | |

This liquid detergent concentrate can be used undiluted as a liquid scourer or diluted with about 100 times its volume of water and applied to floors or other hard surfaces in order to remove fat, oil and others soils, using a suitable applicator. Rinsing the surface afterwards with water will readily remove any residual salts.

Example 4

This example illustrates the formulation of a concentrated detergent composition according to the invention containing a mixture of sodium bicarbonate and sodium oxalate as the water-soluble abrasive salts, which is suitable for cleaning hard surfaces such as sinks, worktops, baths and floors.

The formulation of this detergent concentrate was as follows:

| | % w/w |
|---|---|
| Sodium alkylbenzene sulphonate | 6 |
| Ethoxylate fatty alcohol $C_{9-11}$.8EO (DOBANOL 91-8) | 2 |
| Sodium bicarbonate | 7.68 |
| Sodium oxalate | 20 |
| Water | 64.32 |
| weight ratio of anionic detergent to nonionic detergent = 3:1 | |
| viscosity at 20° C. = 0.12 Pas at a shear rate of 21 sec$^{-1}$, and >6500 Pas at a shear rate of 3 × $10^{-5}$ sec$^{-1}$. | |

This formulation contained a total of 17% by weight of undissolved salt to provide a solid phase of particles having abrasive properties.

This liquid detergent concentrate can be used undiluted as a liquid scourer or diluted with about 100 times its volume of water and applied to floors or other hard surfaces in order to remove fat, oil and others soils, using a suitable applicator. Rinsing the surface afterwards with water will readily remove any residual salts.

Example 5

This example illustrates the formulation of a concentrated detergent composition according to the invention containing a mixture of sodium bicarbonate and dicarboxylic acids as the water-soluble abrasive salts, which is suitable for cleaning hard surfaces such as sinks, worktops, baths and floors.

The formulation of this detergent concentrate was as follows:

| | % w/w |
|---|---|
| Sodium alkylbenzene sulphonate | 6 |
| Ethoxylate fatty alcohol $C_{9-11}$.8EO (DOBANOL 91-8) | 2 |
| Sodium bicarbonate | 7.68 |
| SOKALAN DCS* | 20 |
| Water | 62.32 |
| weight ratio of anionic detergent to nonionic detergent = 3:1 | |
| viscosity at 20° C. = 0.14 Pas at a shear rate of 21 $sec^{-1}$ and >6500 Pas at a shear rate of $3 \times 10^{-5}$ $sec^{-1}$. | |

*SOKALAN DCS is a mixture of adipic acid, glutaric acid and succinic acid; sufficient sodium hydroxide was added to the formulation to provide a pH of greater than 7 and so to convert these free acids to their respective sodium salts. This formulation accordingly contained a total of 8% by weight of undissolved salt to provide a solid phase of particles having abrasive properties.

This liquid detergent concentrate can be used undiluted as a liquid scourer or diluted with about 100 times its volume of water and applied to floors or other hard surfaces in order to remove fat, oil and others soils, using a suitable applicator. Rinsing the surface afterwards with water will readily remove any residual salts.

I claim:

1. A pourable, homogenous, abrasive aqueous detergent composition which does not sediment upon standing and which is suitable for cleaning hard surfaces, consisting essentially of:

(i) 1.5 to 30% by weight of detergent active compound comprising synthetic anionic detergent active and nonionic detergent active in the ratio of 1:1 to 9:1 by weight;

(ii) 15 to 45% by weight sodium bicarbonate salt at least 5% by weight of the total composition of which at 20° C. comprises a solid phase in the form of undissolved particles having a mean particle diameter of from 20 to 300 um;

(iii) the balance of the composition comprising from 25 to 92.5% by weight water;

the compositions having an apparent viscosity at 20° C. of at least 6500 Pas at a shear rate of $3\times10^{-5}$ $sec.^{-1}$, and not more than 10 Pas at a shear rate of 21 $sec.^{-1}$.

2. A pourable, homogeneous, aqueous detergent composition which does not sediment upon standing and which is suitable for cleaning hard surfaces consisting essentially of:

(i) from 2 to 8% by weight of a water-soluble synthetic anionic sulphated or sulphonated detergent salt containing an alkyl radical having from 8 to 22 carbon atoms in the molecule;

(ii) from 0.5 to 4% by weight of an alkyleneoxylated nonionic detergent derived from 8 to 22 carbon atoms in the molecule with ethylene oxide, such that the condensation product has from 2 to 15 moles of ethylene oxide per mole of aliphatic alcohol;

(iii) from 15 to 45% by weight sodium bicarbonate, at least 5% by weight of the total composition of which at 20° C. comprises a solid phase in the form of undissolved particles having a mean particle diameter of from 20 to 300 μm;

(iv) from 40 to 80% by weight of water;

(v) the balance of the composition other detergent adjuncts;

the composition having an apparent viscosity at 20° C. of at least 25,000 Pas at a shear rate of $3\times10^{-5}$ $sec.^{-1}$, and not more than 5 Pas at a shear rate of 21 $sec.^{-1}$.

3. The composition of claim 1, wherein the anionic detergent active compound comprise from 1.5 to 25% by weight of the composition.

4. The composition of claim 1, wherein the nonionic detergent active compound comprise from 1.5 to 15% by weight of the composition.

5. The composition of claim 2, wherein the weight ration of anionic to nonionic detergent active compound is from 1:1 to 9:1.

6. The composition of claim 1, wherein the saturation solubility in water of the sodium bicarbonate at 40° C. is less than eight times that at 10° C.

7. The composition of claim 1, which has an apparent viscosity at 20° C. of at least 25,000 Pas at a shear rate of $3\times10^{-5}$ $sec.^{-1}$.

8. The composition of claim 1, which has an apparent viscosity at 20° C. of not more than 5 Pas at a shear rate of 21 $sec.^{-1}$.

9. The composition of claim 1, wherein the total amount of the sodium bicarbonate, at least 5% by weight of the composition of which at 20° C. comprises a solid phase in the form of undissolved particles, is present in the composition at from about 20% to 45% by weight.

10. The composition according to claim 1, wherein the composition is not flocculated.

* * * * *